United States Patent [19]

Brooks et al.

[11] 4,414,865

[45] Nov. 15, 1983

[54] BEVERAGE BOTTLE AND CAN OPENER

[76] Inventors: Paul Brooks, 2701 Edwin Pl.; John P. Brooks, 2112 Outpost Dr., both of Los Angeles, Calif. 90068

[21] Appl. No.: 352,806

[22] Filed: Feb. 26, 1982

[51] Int. Cl.[3] ..... B67B 7/44; B67B 7/40; B67B 7/18

[52] U.S. Cl. ..... 81/3.1 R; 81/3.46 R; 81/3.34; D8/40

[58] Field of Search ..... 81/3.1 R, 3.46 R, 3.34; 7/151; D8/33, 34, 18, 40, 105

[56] References Cited

U.S. PATENT DOCUMENTS

| | | | |
|---|---|---|---|
| D. 261,854 | 11/1981 | Nielsen | D8/40 |
| 4,253,352 | 3/1981 | O'Neal | 81/3.46 R |
| 4,309,921 | 1/1982 | Miller | 81/3.46 R |

FOREIGN PATENT DOCUMENTS

| | | | |
|---|---|---|---|
| 27609 | 7/1930 | Australia | 81/3.46 R |
| 2256600 | 5/1974 | Fed. Rep. of Germany | 81/3.46 R |
| 1067570 | 1/1954 | France | 81/3.46 R |
| 44336 | 10/1938 | Netherlands | 81/3.4 |

*Primary Examiner*—Roscoe V. Parker

*Attorney, Agent, or Firm*—Fulwider, Patton, Rieber, Lee & Utecht

[57] ABSTRACT

A combined opener for removing a twist-off bottle cap and the lift-off tab of a beverage can. The opener body is provided with a downwardly opening recess formed with protuberances adapted to complementarily mate with the knurls of a twist-off bottle cap. The body is also formed with a socket that receives the pull-tab of a beverage can

6 Claims, 6 Drawing Figures

BEVERAGE BOTTLE AND CAN OPENER

FIELD OF THE INVENTION

This invention relates to a combined opener for twist-off bottle caps and the lift-off tab of a beverage can.

BACKGROUND OF THE INVENTION

Soft drink bottles, beer bottles, and the like are often provided with a screw-cap closure commonly termed a "twist-off" cap. The consumer removes the cap by unscrewing same relative to the bottle. Also, the bottle may be resealed after the cap has been initially removed by screwing it back onto the top of the bottle. In some instances, however, the cap is so tightly secured to the bottle that it is difficult to remove manually without the assistance of a tool, such as tongs or pliers. Additionally, it is not always possible to retighten the cap sufficiently to effectively re-seal the cap on the bottle.

Many beverage cans are presently provided with lift-off tabs. Such tabs include a ring adapted to be manually grasped whereby the tab may be lifted from the top of the can and then pivoted to expose the opening in the top of the can. Such ring-type tabs are difficult to raise off the can top. This is particularly true in the case of men having stubby fingers, women having long nails, and most children, such persons having a problem in inserting their fingers beneath the ring as a prerequisite to its removal. Moreover, it requires manual dexterity and comparative strength to complete the lifting of the tab after it has been raised off the can top.

To solve the problems, there have heretofore been provided openers for twist-off caps having a recess provided with protuberances for engaging the knurls of such caps. Openers of this type are shown in U.S. Pat. No. Des. 261,854, U.S. Pat. No. 3,919,901 and U.S. Pat. No. 2,631,482. To applicant's knowledge, however, there has not been heretofore provided an opener for the lift-off tab of a can, much less a combined opener for a twist-off bottle cap and a lift-off tab of a can.

BRIEF SUMMARY OF THE INVENTION

The combined beverage bottle and can opener of the present invention provides a single tool usable to remove a twist-off bottle cap and the lift-off tab of a beverage can. The opener includes a body member provided with a recess formed with protuberances adapted to complementarily mate with the knurls of a twist-off bottle cap, with such body also being formed with a socket that extends outwardly from one side of the recess to receive the lift-tab of a beverage can. The body is rotated to remove a twist-off bottle cap, and the body is raised upwardly and forwardly to lift the lift-tab relative to the top of the beverage can.

DESCRIPTION OF A PREFERRED EMBODIMENT

Figure 1:
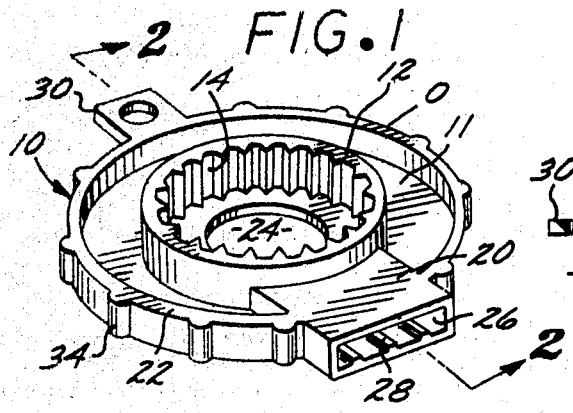
FIG. 1 is a perspective view of a preferred form of combined bottle and can opener embodying the present invention.

Referring now to the drawings, the combined bottle and can opener O of the present invention is preferably integrally molded of a hard synthetic plastic. Such opener, however, could be formed of metal.

Figure 2:
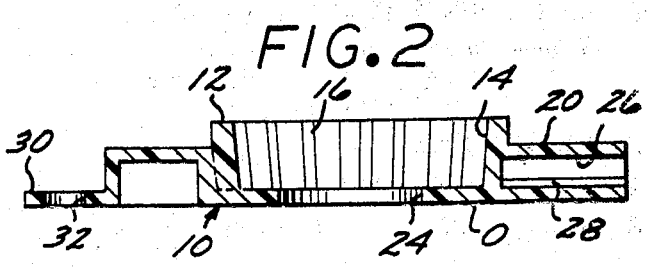
FIG. 2 is a vertical sectional view taken in enlarged scale along lines 2—2 of FIG. 1.
Figure 3:
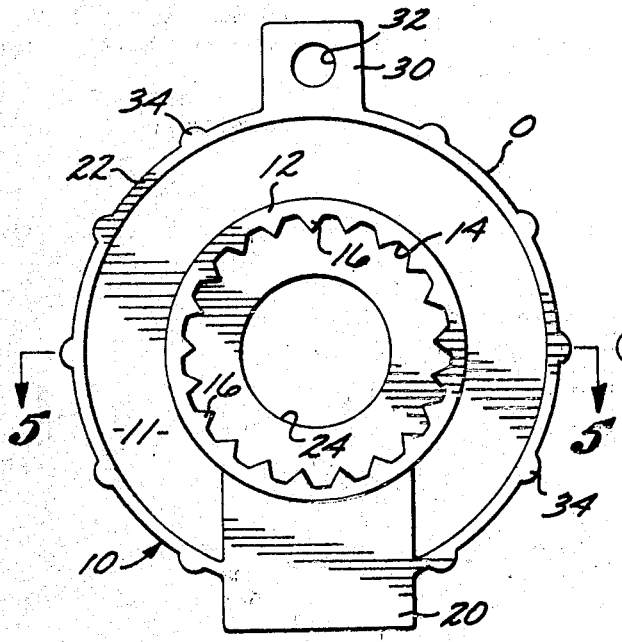
FIG. 3 is a view showing the underside of said opener.
Figure 4:
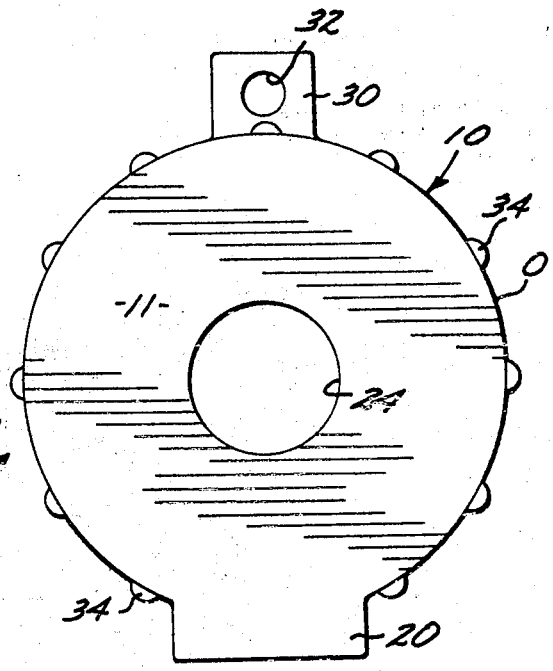
FIG. 4 is a top-plan view of said opener.

In FIGS. 1 and 2, opener O is shown inverted relative to its normal position in the interest of clarity. Opener O includes a body member, generally designated 10, of arcuate configuration. Body 10 includes a flat wall 11 provided with a coaxial depending neck 12, the interior of which defines a downwardly opening recess 14 formed about its periphery with protuberances 16. A horizontally extending socket 20 projects radially outwardly from one side of neck 12. The intermediate portion of socket 20 intersects a lip 22 which depends from the outer periphery of body wall 11. A coaxial circular opening 24 is formed in body 10, with its diameter being less than the diameter of neck 12. Socket 20 defines a horizontally extending tunnel 26, the upper surface of which is formed with a plurality of reinforcing ribs 28. A horizontal hanging ear 30 formed with a hole 32 extends radially outwardly from the lower edge of neck 12 diametrically opposite socket 20. The periphery of lip 22 is formed with a plurality of circumferentially spaced knobs 34.

Figure 5:
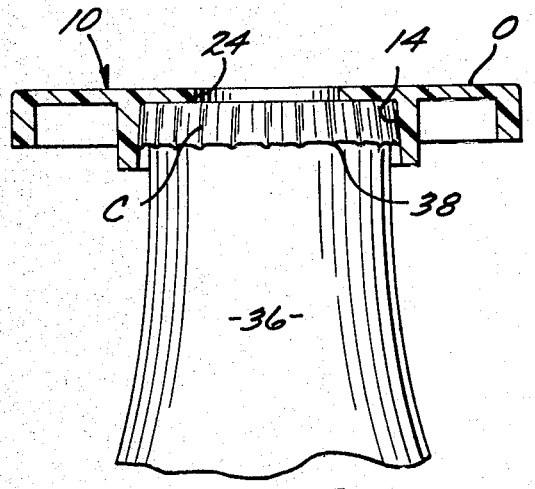
FIG. 5 is a vertical sectional view taken along lines 5—5 of FIG. 3 showing the opener applied to a twist-off bottle cap.

In using the opener O to remove the twist-off cap C from the top of a bottle 36, the opener is lowered over the cap C as indicated in FIG. 5. The protuberances 16 of the socket 20 are complementarily mated with the knurls 38 of cap C. The opener 0 is then manually rotated in the proper direction to screw the cap C off of the top of bottle 36. Rotation of the opener O is facilitated by the engagement of the consumer's fingers with knobs 34 and/or the sides of socket 20 and hanging ear 30. It has been found that removal of twist-off caps by means of the opener O is greatly facilitated as compared to the use of the consumer's fingers alone. If it desired to replace the cap C on the bottle 36, the opener O may be utilized for this purpose. It will be noted that considerably more closing pressure can be applied by means of the opener O than solely by the use of a consumer's fingers. Note also that if a cap C sticks within socket 20, it may be readily removed by exerting digital pressure against the top of the cap through body opening 24.

Figure 6:
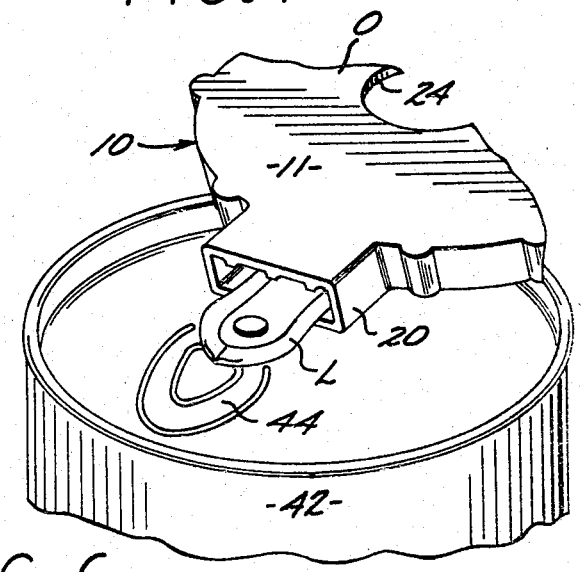
FIG. 6 is a perspective view showing said opener during a lift-tab removal operation.

Referring now to FIG. 6, when it is desired to utilize opener O to raise the lift tab L of a beverage can 42, socket 20 is slipped over the free end of the lift tab L whereby the latter is received in tunnel 26. Thereafter, the opener O is urged forwardly and upwardly with a generally pivotal movement so as to cause the lift tab to puncture and depress the seal 44 formed in the top 46 of the can 42. This lifting and raising operation is greatly facilitated by the use of the opener O.

It should be noted that the reinforcing ribs 28 not only serve to strengthen the socket 20, but also provide a more snug fit between the lift tab L and the socket tunnel 26 while permitting the height of the socket to be the same as the height of lip 22. The equivalency of the heights of the socket and the lip not only afford an aesthetically pleasing arrangement, but additionally facilitates the molding of the opener from a synthetic plastic.

While there has been shown and described what is presently considered to be a preferred embodiment of the present invention, it will be apparent that various modifications and changes may be made with respect to the foregoing detailed description without departing from the spirit of the present invention.

We claim:

1. A combined opener for a twist-off bottle cap on a beverage can lift-off tab, said opener comprising:

a body member provided with a downwardly opening recess formed about its periphery with protuberances adapted to complementarily mate with the knurls of said bottle cap;

a horizontal socket extending outwardly from one side of said recess, said socket being formed with a tunnel to receive said lift-off tab;

a downwardly depending peripheral lip member circumferentially disposed about said side of said recess, said horizontal socket formed in one piece formation with said side of said recess and said lip member; and, with said body member being rotated when said recess is applied over a twist-off bottle cap to facilitate the removal of said cap from said bottle, and said body member being raised upwardly when said socket is applied over the lift-off tab of a can to lift said tab from said can.

2. An opener as set forth in claim 1, wherein said body is formed with a central opening to permit digital access to a bottle cap stuck in said socket.

3. An opener as set forth in claim 1, wherein said body is provided with a depending neck, the interior of which defines said recess, and with said socket extending horizontally outwardly from one side of said neck.

4. An opener as set forth in claim 2, wherein said body is provided with a depending neck, the interior which defines said recess, and with said socket extending horizontally outwardly from one side of said neck.

5. An opener as set forth in claim 3, wherein said body includes a flat plate centrally formed with said neck, said plate also being formed in one-piece formation with said peripheral lip member, with the height of said socket being the same as the height of said lip member, and the tunnel of said socket is formed with reinforcing rib means.

6. An opener as set forth in claim 5, wherein said plate is formed with a central opening to permit digital access to a bottle cap stuck in said socket.

* * * * *